US007871213B2

(12) United States Patent
Lodwig et al.

(10) Patent No.: US 7,871,213 B2
(45) Date of Patent: Jan. 18, 2011

(54) RIBBON CARTRIDGE INCLUDING SUBSTRATE CLEANING APPARATUS

(75) Inventors: Dean H. Lodwig, West Hills, CA (US); Caleb J. Bryant, Moorpark, CA (US); Lionel C. Chavarria, Moorpark, CA (US); Daniel E. Perry, Camarillo, CA (US)

(73) Assignee: ZIH Corp., Hamilton (BM)

( * ) Notice: Subject to any disclaimer, the term of this patent is extended or adjusted under 35 U.S.C. 154(b) by 0 days.

(21) Appl. No.: 11/381,899

(22) Filed: May 5, 2006

(65) Prior Publication Data

US 2006/0251461 A1 Nov. 9, 2006

Related U.S. Application Data

(63) Continuation of application No. 10/690,395, filed on Oct. 20, 2003, now abandoned.

(51) Int. Cl.
*B41J 32/00* (2006.01)

(52) U.S. Cl. ..... 400/208; 347/214

(58) Field of Classification Search ..... 400/207, 400/208, 578, 701; 347/215, 218, 221, 214; 399/107; 101/425, 423
See application file for complete search history.

(56) References Cited

U.S. PATENT DOCUMENTS 4,350,453 A 9/1982 Field et al.
4,519,600 A 5/1985 Warwick et al.
4,644,370 A 2/1987 Watanabe (Continued)

FOREIGN PATENT DOCUMENTS

DE 25 35 699 3/1977

(Continued)

OTHER PUBLICATIONS

European Search Report for EP 06006810.3, completed on Jul. 12, 2006.

(Continued)

*Primary Examiner*—Leslie J Evanisko
(74) *Attorney, Agent, or Firm*—Alston & Bird LLP

(57) ABSTRACT

A printer configured to print on substrates that undesirably tend to collect debris before being printed, comprises a print station including a printhead, and a printer body configured to receive a replaceable cartridge that holds a printer consumable (such as a ribbon) and a substrate cleaning structure. The printer body is constructed and arranged so that when a cartridge is received in the body, the cleaning structure is operable to at least assist in removing debris from a substrate. The cleaning structure may comprise a tacky or sticky belt, web or roller. The cleaning structure may be configured to present a sticky surface to a primary cleaning member that engages and cleans the substrates. Alternatively, the cleaning structure may be configured to directly engage and clean the substrates. Preferably, the useful lives of the cleaning structure and the printer consumable are commensurate. Also disclosed is a replaceable cartridge that holds both a printer consumable and a substrate cleaning structure, the cartridge being configured so that when it is received in a printer it is operable to at least assist in removing debris from a substrate. Also disclosed are a method of cleaning an information-receiving surface of a substrate and a method of cleaning a substrate-cleaning member of a substrate printer.

9 Claims, 4 Drawing Sheets

U.S. PATENT DOCUMENTS

| | | | | |
|---|---|---|---|---|
| 4,676,678 | A | 6/1987 | Watanabe | |
| 4,733,980 | A | 3/1988 | Tosa | |
| 4,983,056 | A | 1/1991 | Falconieri et al. | |
| 5,078,523 | A | 1/1992 | McGourty et al. | |
| 5,128,763 | A | 7/1992 | Sakuragi | |
| 5,318,370 | A | 6/1994 | Nehowig | |
| 5,326,179 | A | 7/1994 | Fukai et al. | |
| 5,401,111 | A | 3/1995 | Nubson et al. | |
| 5,415,486 | A | 5/1995 | Wouters et al. | |
| 5,455,617 | A | 10/1995 | Stephenson et al. | |
| 5,529,411 | A | 6/1996 | Nakata et al. | |
| 5,558,449 | A | 9/1996 | Morgavi | |
| 5,600,362 | A | 2/1997 | Morgavi et al. | |
| 5,667,316 | A | 9/1997 | Nardone et al. | |
| 5,771,058 | A | 6/1998 | Kobayashi | |
| 5,810,490 | A | 9/1998 | Kondo | |
| 5,825,392 | A | 10/1998 | Mochizuki | |
| 5,959,278 | A | 9/1999 | Kobayashi et al. | |
| 5,984,546 | A | 11/1999 | Kameyama | |
| 6,109,801 | A | 8/2000 | Mabit | |
| 6,151,037 | A | 11/2000 | Kaufman et al. | |
| 6,249,303 | B1 | 6/2001 | Mochizuki et al. | |
| 6,285,845 | B1 | 9/2001 | Liatard et al. | |
| 6,386,772 | B1 | 5/2002 | Klinefelter et al. | |
| 6,408,151 | B1 | 6/2002 | Heno | |
| 6,448,991 | B1 | 9/2002 | Doan | |
| 6,554,512 | B2 | 4/2003 | Heno et al. | |
| 6,567,112 | B2 | 5/2003 | Suzuki | |
| 6,582,141 | B2 | 6/2003 | Meier et al. | |
| 6,587,135 | B1 | 7/2003 | Suzuki et al. | |
| 6,648,527 | B2 | 11/2003 | Takahashi et al. | |
| 6,676,312 | B2 | 1/2004 | Richard | |
| 6,694,884 | B2 | 2/2004 | Klinefelter et al. | |
| 6,722,649 | B2 | 4/2004 | Yui | |
| 6,798,434 | B2 | 9/2004 | Shibata et al. | |
| 6,840,689 | B2 | 1/2005 | Barrus et al. | |
| 6,877,918 | B2 | 4/2005 | Takahashi et al. | |
| 6,902,107 | B2 * | 6/2005 | Shay et al. | 235/381 |
| 6,938,896 | B2 | 9/2005 | Tsuchida | |
| 6,942,212 | B2 | 9/2005 | Koh | |
| 7,018,117 | B2 | 3/2006 | Meier et al. | |
| 7,198,262 | B2 | 4/2007 | Hartl et al. | |
| 2001/0052923 | A1 | 12/2001 | Suzuki | |
| 2002/0106229 | A1 | 8/2002 | Meier et al. | |
| 2002/0153657 | A1 | 10/2002 | Tsuchida | |
| 2003/0059050 | A1 | 3/2003 | Hohberger et al. | |
| 2003/0201597 | A1 | 10/2003 | Koh | |
| 2004/0018035 | A1 | 1/2004 | Petteruti et al. | |
| 2004/0114981 | A1 | 6/2004 | Meier et al. | |

FOREIGN PATENT DOCUMENTS

| | | | |
|---|---|---|---|
| EP | 0 562 979 | A2 | 9/1993 |
| EP | 0 622 242 | A | 11/1994 |
| EP | 0 979 736 | A1 | 2/2000 |
| EP | 0 887 197 | A3 | 5/2000 |
| EP | 1 095 783 | B1 | 12/2003 |
| GB | 2 120 821 | A | 12/1983 |
| JP | 55-55880 | | 4/1980 |
| JP | 55-158988 | | 12/1980 |
| JP | 57-123084 | | 7/1982 |
| JP | 59-1290 | | 1/1984 |
| JP | 59-199279 | | 11/1984 |
| JP | 60-155487 | | 8/1985 |
| JP | 63-197163 | | 12/1988 |
| JP | 1-135680 | | 5/1989 |
| JP | 2-36460 | | 3/1990 |
| JP | 2-171275 | | 7/1990 |
| JP | 3-121861 | | 12/1991 |
| JP | 4-122669 | | 4/1992 |
| JP | 4-128078 | | 4/1992 |
| JP | 4-220385 | | 8/1992 |
| JP | 4-221670 | | 8/1992 |
| JP | 5-96803 | | 4/1993 |
| JP | 5-96836 | | 4/1993 |
| JP | 5-169696 | | 7/1993 |
| JP | 5-177914 | | 7/1993 |
| JP | 5-318865 | | 12/1993 |
| JP | 6-99631 | | 4/1994 |
| JP | 6-143774 | | 5/1994 |
| JP | 6-227679 | | 8/1994 |
| JP | 6-81750 | | 11/1994 |
| JP | 6-320764 | | 11/1994 |
| JP | 7-42697 | | 8/1995 |
| JP | 8-90880 | | 4/1996 |
| JP | 8-332764 | | 12/1996 |
| JP | 9-39348 | | 2/1997 |
| JP | 9-141987 | | 6/1997 |
| JP | 9-254479 | | 9/1997 |
| JP | 9-272213 | | 10/1997 |
| JP | 10-29327 | | 2/1998 |
| JP | 11-105359 | | 4/1999 |
| JP | 11-265463 | | 9/1999 |
| JP | 2000-015911 | | 1/2000 |
| JP | 2000-246985 | | 9/2000 |
| JP | 2000313153 | A * | 11/2000 |
| JP | 2000-335065 | | 12/2000 |
| JP | 2001-205906 | | 7/2001 |
| JP | 2002-120446 | | 4/2002 |
| JP | 2002-137433 | | 5/2002 |
| JP | 2002-178585 | | 6/2002 |
| WO | WO 95/09084 | A1 | 4/1995 |
| WO | WO 99/04368 | A1 | 1/1999 |
| WO | WO 99/21713 | A1 | 5/1999 |
| WO | WO 99/49379 | A2 | 9/1999 |
| WO | WO 02/32200 | A | 4/2002 |
| WO | WO 03/019459 | A3 | 3/2003 |
| WO | WO 2004/011268 | A1 | 2/2004 |

OTHER PUBLICATIONS

International Search Report for PCT/US2005/000795, Mailed Aug. 5, 2005.

International Search Report for PCT/US2004/032053, Mailed Feb. 16, 2005.

European Search Report for EP 06125566.7, completed on May 31, 2007, mailed Jun. 13, 2007.

* cited by examiner

FIG. 2
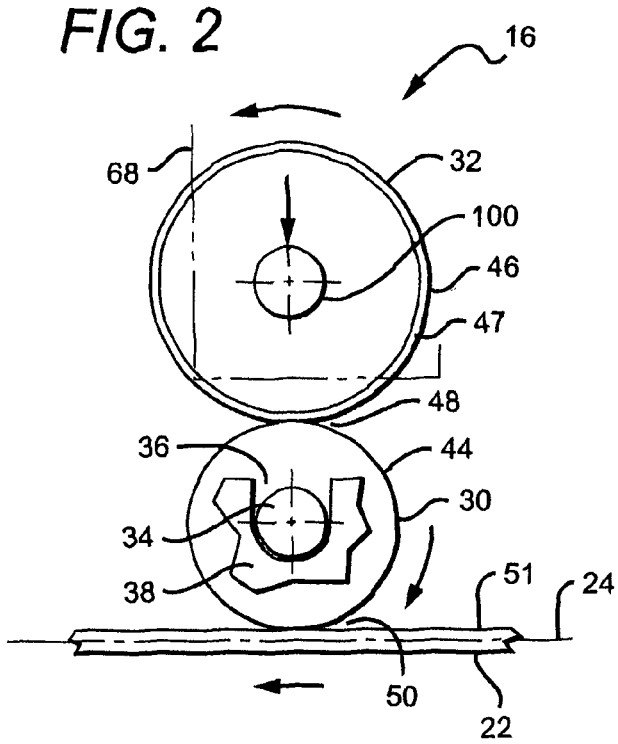
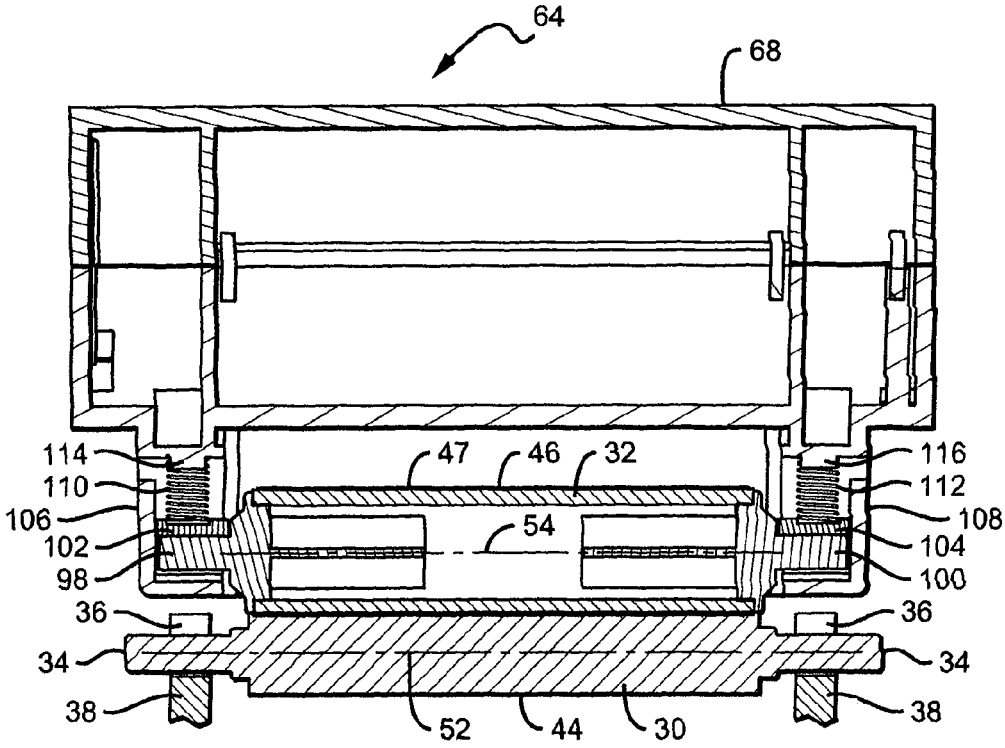
FIG. 3

FIG. 4
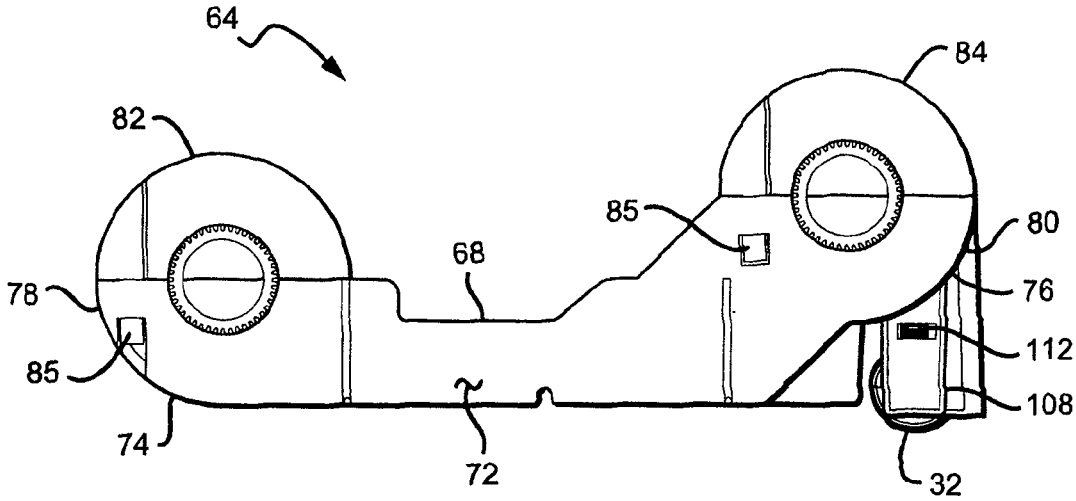
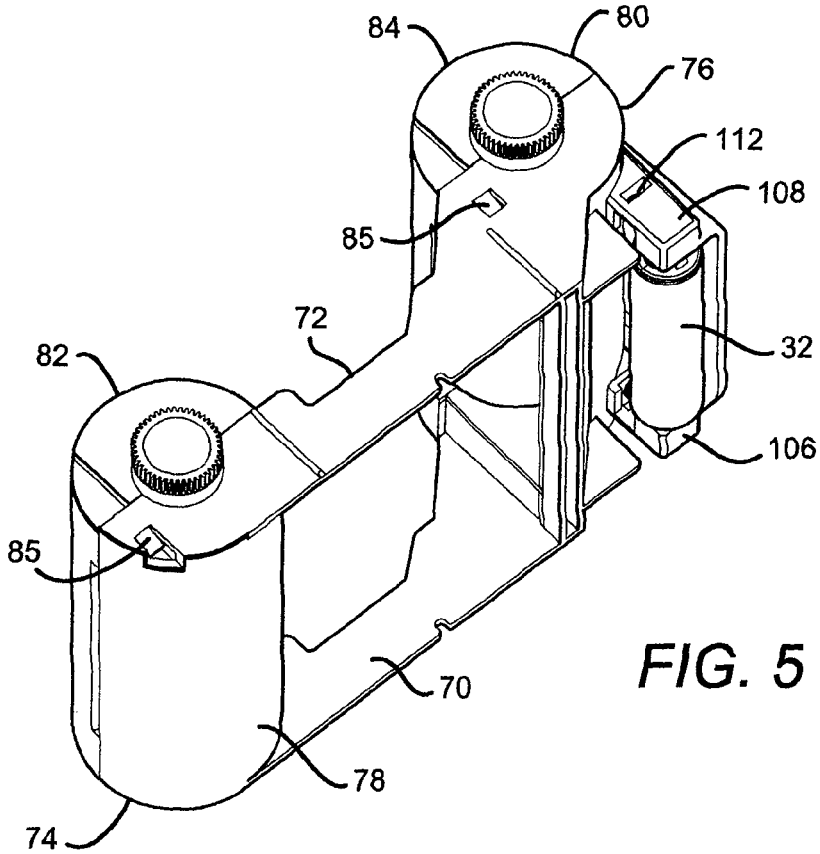
FIG. 5

FIG. 6
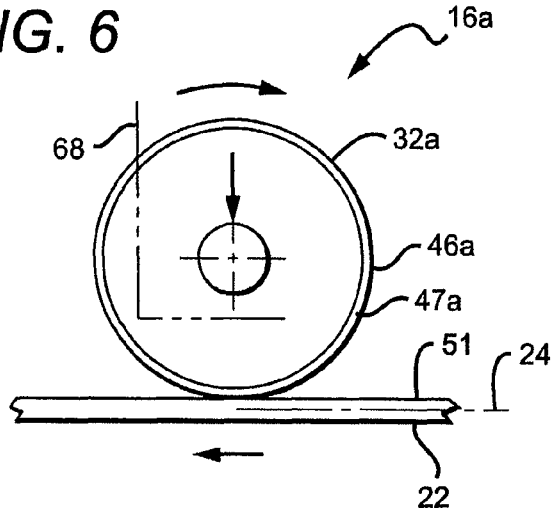
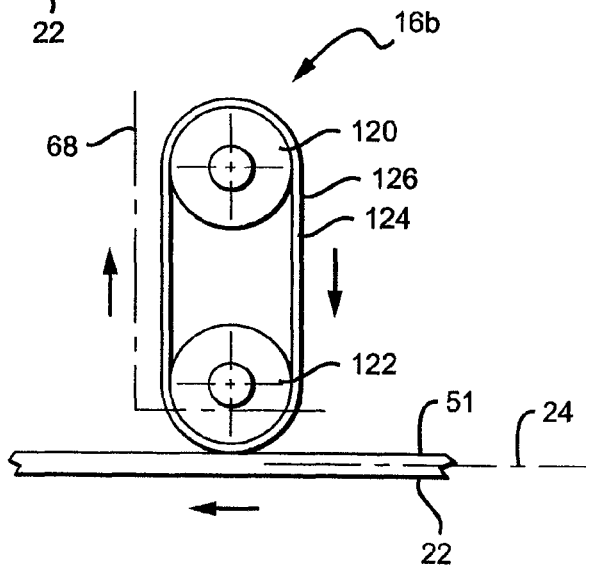
FIG. 7
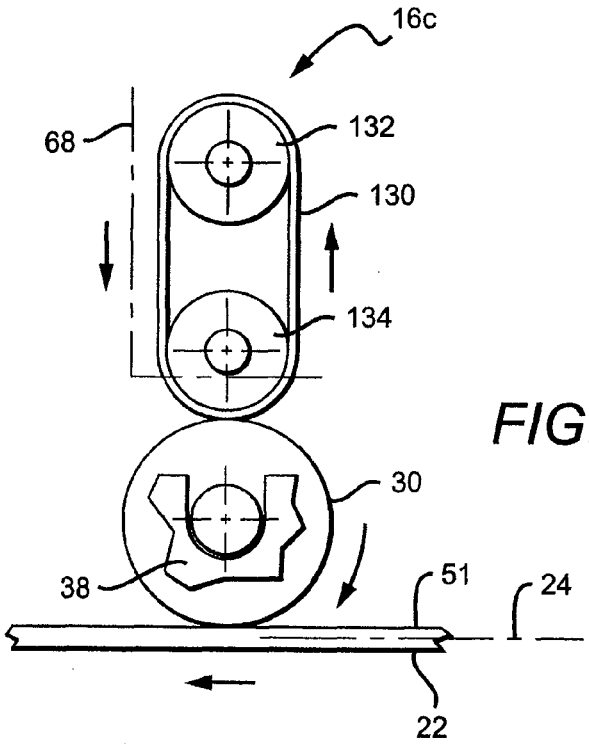
FIG. 8

RIBBON CARTRIDGE INCLUDING SUBSTRATE CLEANING APPARATUS

CROSS-REFERENCE TO RELATED APPLICATIONS

This application is a continuation of U.S. application Ser. No. 10/690,395, filed Oct. 20, 2003 now abandoned, which is hereby incorporated herein in its entirety by reference.

FIELD OF THE INVENTION

The present invention relates generally to printers for printing on discrete, flexible, information-bearing substrates such as plastic cards, and particularly to an apparatus and a method for removing particulate matter such as dust and/or other debris from the substrates before information is printed thereon.

BACKGROUND OF THE INVENTION

Printers for printing information on discrete, flexible substrates such as plastic identification cards, drivers licenses, prepaid cards, and the like, conventionally comprise a substrate hopper and feeder for storing and supplying a succession of individual substrates to be printed; a substrate cleaning station for cleaning the surface of each substrate prior to printing; a print station typically comprising a thermal printhead cooperating with a thermal transfer ribbon or dye sublimation ribbon to print the information on the information-receiving surface of the substrate; and a discharge station for receiving the printed substrates.

The thermal printhead is actuated by a drive mechanism to move the head toward and away from a platen roller in synchronization with the sequential transportation of the substrates past the print station. Printing is effected through the thermal transfer or dye sublimation ribbon positioned between the printhead and the substrate. The thermal printhead has a transverse tip carrying a large number of heatable elements selected ones of which are energized to transfer an ink or a dye from the ribbon to the substrate. The ribbon is typically carried by a replaceable ribbon cartridge that is disposed of when the ribbon is spent.

As is known, the printable surface of information-bearing substrates and particularly those in the form of cards made of plastics such as PVC, must be clean so as to provide a high quality representation of the printed information (and particularly so where the information is applied by a high temperature thermal printing process) and to protect the printhead from being damaged. A substrate cleaning station is therefore provided upstream of the printing station. The cleaning station typically comprises a cleaning platen roller that rides in contact with the information-receiving surface of each of the substrates successively fed through the printer. The cleaning platen roller has a surface of, for example, silicone, treated to make the surface tacky so as to lift particulate matter such as dust and/or other debris (hereinafter "debris") from the print-receiving substrate surface. It will be evident that as the tacky surface of the cleaning roller accumulates debris the roller will lose its effectiveness so that the cleaning roller itself needs to be kept clean. Alternatively, the cleaning roller must be replaced when the tacky surface becomes saturated with debris.

In one approach, the tacky cleaning roller is periodically cleaned by means of a sticky debris removal member in the form of a sticky tape fed from a tape supply roll against the surface of the tacky cleaning roller and from there to a tape take-up roll. The sticky tape supply and take-up rolls are carried by a tape carrier. When the sticky tape is consumed, the tape carrier is disposed of and replaced. In another conventional approach, a sticky removal member in the form of a sticky roller riding in contact with the surface of the tacky cleaning platen roller is used to clean the platen roller. When the sticky roller loses its effectiveness it is disposed of and replaced.

Thus, in conventional substrate printers, both the sticky removal member and the ribbon cartridge must be separately removed and individually replaced. It has been found, however, that most end users neglect to change the sticky removal member when it loses its debris-lifting effectiveness. As a result, debris remaining on the substrate surface can enter the print mechanism causing poor print quality and ultimately leading to the destruction of the printhead that is the most expensive component of the printer.

BRIEF DESCRIPTION OF THE DRAWINGS

The objects, features and advantages of the invention will be evident to those skilled in the art from the detailed description below, taken together with the accompanying drawings, in which:

FIG. 2 is an enlarged side elevation view of a portion of the cleaning station of the printer of FIG. 1;

FIG. 3 is an end elevation view, in cross section, of a portion of the cleaning station of the printer as seen along the line 3-3 in FIG. 1;

FIG. 4 is a side elevation view of a ribbon cartridge in accordance with the invention;

FIG. 5 is a perspective view of the ribbon cartridge of FIG. 4;

FIG. 6 is a side elevation view of a portion of a substrate cleaning station in accordance with an alternative embodiment of the invention;

FIG. 7 is a side elevation view of a portion of a substrate cleaning station in accordance with another embodiment of the invention; and FIG. 8 is a side elevation view of a portion of a substrate cleaning station in accordance with yet another embodiment of the invention.

DETAILED DESCRIPTION OF THE INVENTION

Figure 1:
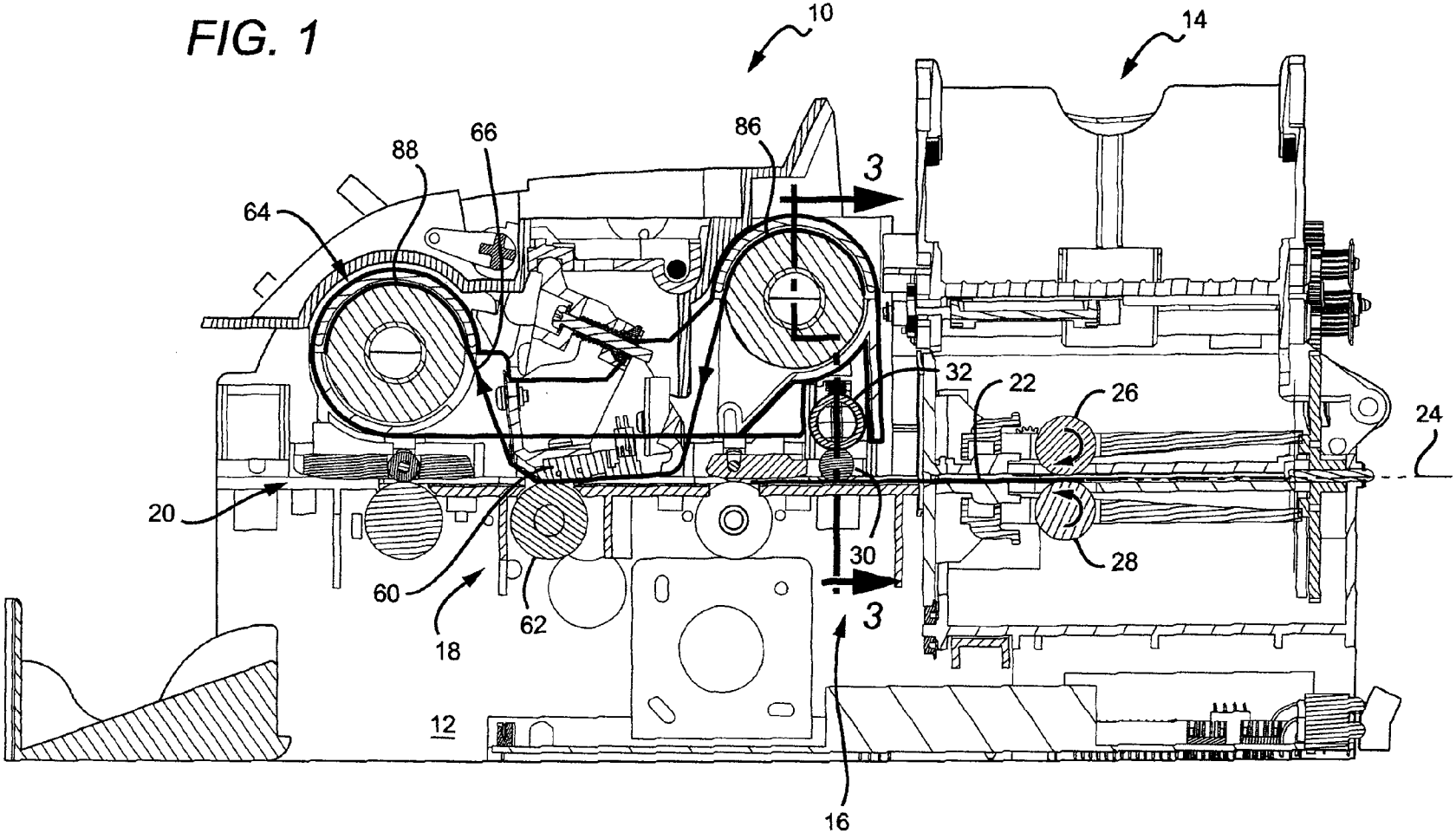
FIG. 1 is a side elevation view, partly in cross section, of a portion of a thermal transfer substrate printer incorporating one specific, exemplary embodiment of the invention.

The following description is of a best mode presently contemplated for practicing the invention. This description is not to be taken in a limiting sense but is made merely for the purpose of describing the general principles of the invention whose scope is defined by the appended claims.

With reference to FIG. 1, there is shown a portion of a thermal transfer printer 10 incorporating a specific, exemplary embodiment of the present invention. As is known, thermal transfer printers are typically used to print information in the form of text, graphics, photographs, and so forth, on plastic cards such as I.D. cards, drivers' licenses, and the like using a printer consumable such as a thermal transfer or dye sublimation ribbon carried by a disposable ribbon cartridge. It will be evident to those skilled in the art that the present invention has broader utility, being applicable to a wide variety of information-receiving media including substrates of paper or cardboard. Thus, it will be understood that the context in which the present invention is described in detail is exemplary only and is not intended to be limiting of the scope of the invention.

The thermal transfer substrate printer 10 generally comprises a printer body or frame 12, a substrate supply and feeder station 14, a substrate cleaning station 16, a substrate print station 18 and a substrate discharge station 20. Individual substrates 22 are transported in succession from right to left, as viewed in FIG. 1, along a substantially horizontal substrate feed path 24 between the substrate supply and feeder station 14 and the discharge station 20.

The substrate supply and feeder station 14 is conventional and need not be described in detail. Suffice it to say that the substrate supply and feeder station 14 includes a pair of opposed, counter-rotating substrate drive rollers 26 and 28 for transporting individual substrates along the substrate feed path 24 toward the substrate cleaning station 16.

With reference now also to FIGS. 2 and 3, the substrate cleaning station 16 comprises the stacked combination of a first cleaning member 30 and a second cleaning member 32 above the first member 30. The first cleaning member 30 is typically in the form of a roller having end shafts 34 cradled for rotation within vertical slots 36 formed in opposed printer frame side members 38. The cleaning roller 30 is thereby vertically displaceable relative to the printer frame 12 in response to the presence of the substrates and to accommodate variations in substrate thickness. At the substrate cleaning station 16, each substrate 22 passes under the first or primary cleaning roller 30 in contact with an outer surface 44 thereof. The surface 44 of the first cleaning roller 30 is tacky so that it lifts any debris from the print-receiving surface of each substrate. By way of example, the surface 44 may comprise silicone that has been treated in well-known fashion to make the surface tacky to cause debris to be lifted from the print-receiving substrate surface. The second cleaning roller 32 has an outer sticky surface 46 that rides in contact with the outer tacky surface 44 of the first cleaning roller 30 to remove other debris from the tacky outer surface 44 of the first cleaning roller. For this purpose, the sticking power of the sticky surface 46 of the second cleaning roller 32 is greater than that of the tacky outer surface 44 of the first cleaning roller 30. The sticky surface 46 of the second roller 32 may be provided by covering the roller with a suitably treated coating or layer 47 that may simply comprise double-sided masking tape. (FIGS. 2 and 3). Preferably, the diameter of the second cleaning roller 32 is greater than that of the first cleaning roller 30 so that the effective cleaning surface area of the second roller is greater than that of the first roller and thus can retain a concomitantly greater amount of debris. Preferably, the circumference of the first roller 30 is equal to the length of one of the substrates or cards being processed. Also preferably, the region 48 of engagement between the first and second cleaning rollers is diametrically opposite the region 50 of engagement between the first cleaning roller and the print-receiving surface 51 of the substrate 22 fed along the substrate feed path 24. It will be evident that other positional relationships between the rollers 30 and 32 are possible so long as the second cleaning roller is disposed in contact with the first cleaning roller to effectively remove debris therefrom. It will also be seen that the respective axes of rotation 52 and 54 of the first and second rollers 30 and 32 are parallel and oriented transversely, that is, perpendicular to the direction of the substrate feed path 24.

The substrate print station 18 may comprise a conventional thermal printhead 60, a printing platen roller 62 and a cartridge 64 containing a printer consumable comprising a transfer medium 66 typically in the form of a conventional thermal transfer or dye sublimation ribbon.

Referring now also to FIGS. 4 and 5, the ribbon cartridge 64 is a molded plastic structure comprising a frame 68 including a pair of parallel, spaced-apart, longitudinally oriented support plates 70 and 72. The support plates are molded integrally with the bottom portions 74 and 76 of a pair of spaced-apart, transversely oriented cylindrical spool enclosures 78 and 80, respectively. The enclosures 78 and 80 include top portions 82 and 84, respectively, releasably attached to the bottom enclosure portions 74 and 76 by compressible snaps 85. When the top portions 82 and 84 of the enclosures are removed, access is gained to ribbon supply and take-up spools 86 and 88, respectively (FIG. 1). The ribbon 66 is fed from the ribbon supply spool 86, between the printhead 60 and the printing platen roller 62 and from there to the take-up ribbon spool 88. In conventional fashion, the substrate feed path 24 extends between the thermal transfer ribbon 66 and the printing platen roller 62. Further in conventional fashion, the ribbon cartridge 64 is a removable, replaceable unit that is typically disposed of by the user when the ribbon 66 has been completely used.

In accordance with the present invention, the second cleaning structure or member in the form of roller 32 that comprises part of the cleaning station 16 is mounted on the ribbon cartridge 64. More specifically, the second cleaning roller 32 is rotatable about outer end shafts 98 and 100 journaled in corresponding bearings 102 and 104 carried by the cartridge frame 68. The shaft bearings 102 and 104 are movable vertically within bearing housings 106 and 108 formed integrally with the cartridge frame 68. The bearings 102 and 104 within which the outer ends of the roller shaft 100 are journaled are resiliently biased downwardly (as viewed in FIGS. 1-3) to urge the outer sticky surface 46 of the second cleaning roller 32 into engagement with the outer tacky surface 44 of the first or primary cleaning roller 30 when the cartridge is installed in the printer. The resilient bias of the second cleaning roller is preferably provided by vertical compression springs 110 and 112 captured between upper, fixed spring retainers 114 and 116, respectively, and the corresponding shaft bearings 102 and 104. It will be evident that other resilient biasing means, for example, elastomeric inserts, may be used. The projecting end shafts 34 of the first cleaning roller 30 are pushed down into the slots 36 by the resilient force imposed on the second cleaning roller 32 by the resilient biasing means. Guided by the slots 36, the first cleaning roller 30 is free to move upwardly in response to the substrates 22 passing underneath, the amount of the upward movement of the roller 30 varying with substrate thickness.

In the past, the disposable ribbon cartridge and the disposable sticky cleaning member needed to be changed individually. End users, however, often neglected to change the sticky cleaning member when due for replacement. This allowed debris to remain on the substrate surface and foul the print mechanism. By integrating the ribbon cartridge and the sticky cleaning structure such as the sticky roller 32, in a single unit, only that one part needs to be replaced. A sticky cleaning member is typically discarded after a predetermined number of substrates, for example, about two hundred, have passed through the printer. It happens that this replacement cycle is substantially the same as the replacement cycle of the ribbon so that both will be spent at about the same time.

FIG. 6 shows a portion of a substrate printer cleaning station 16*a* in accordance with a specific, exemplary alternative embodiment of the invention. This embodiment is similar to the cleaning station 16 shown in FIGS. 1 and 2; however, in the embodiment of FIG. 6, the primary cleaning roller 30 on the printer frame has been eliminated and a cleaning structure comprising a roller 32*a*, carried by the ribbon cartridge frame 68 of a replaceable ribbon cartridge, is positioned so that the outer surface 46*a* of the roller 32*a* comes into direct contact with the print-receiving surface 51 of each substrate 22. The outer surface 46*a* of the roller 32*a* may comprise the surface of a tacky or sticky coating or layer 47*a* (such as double-sided masking tape) on the roller 32*a* so that as each substrate 22 is advanced along the feed path 24, any other debris will be lifted from the card surface 51. As before, the useful lives of the cleaning roller 32*a* and the consumable transfer ribbon are preferably commensurate so that both of these elements will be spent when the ribbon cartridge is replaced.

FIG. 7 shows a portion of a substrate printer cleaning station 16*b* in accordance with another specific, exemplary, alternative embodiment of the invention. The cleaning station 16*b* comprises a substrate cleaning structure including a pair of vertically spaced-apart upper and lower, transverse rollers 120 and 122, respectively, journaled for rotation on the frame 68 of a replaceable ribbon cartridge. The substrate cleaning structure further includes a web or belt 124 having a tacky or sticky outer surface 126, the belt 124 being trained around the rollers 120 and 122. When the ribbon cartridge is installed in a printer, the tacky or sticky outer surface 126 of the belt 124 is positioned to directly contact the print-receiving surface 51 of each substrate 22 and to thereby lift any debris from the substrate surface 51 while the belt is driven in the direction shown by the arrows by the moving substrate. As before, the transfer medium cartridge and cleaning structure carried thereby are disposed of and replaced as a unit, with the useful lives of the transfer medium or ribbon and the cleaning structure being preferably made to be commensurate.

FIG. 8 shows a portion of a substrate printer cleaning station 16*c* in accordance with yet another specific, exemplary embodiment of the invention. The cleaning station 16*c* is similar to the cleaning station 16 of the first embodiment in that it includes a tacky primary cleaning roller 30 that is carried by the printer frame side members 38 and that rides in contact with and removes any debris from the print-receiving surface 51 of each substrate 22 as the substrate is transported along the feed path 24. The cleaning station 16*c* further comprises a substrate cleaning structure in the form of a sticky web or belt 130 trained about a pair of spaced-apart, upper and lower rollers 132 and 134 journaled for rotation on the frame 68 of a replaceable ribbon cartridge. The lower extremity of the sticky belt 130 contacts the surface of the tacky roller 30 to remove any debris therefrom, analogous to the action of the sticky roller 32 of the first embodiment. Disposal and replacement of the ribbon cartridge simultaneously disposes of and replaces the sticky belt 130 carried by the cartridge.

While several illustrative embodiments of the invention have been shown and described, numerous variations and alternative embodiments will occur to those skilled in the art. Such variations and alternative embodiments are contemplated, and can be made without departing from the spirit and scope of the invention as defined in the appended claims.

What is claimed is:

1. A ribbon cartridge for printing on a succession of substrates proceeding along a substantially horizontal path, said ribbon cartridge comprising:

a ribbon supply spool holding a supply of printer ribbon;

a ribbon take-up spool configured to take-up a consumed portion of the supply of printer ribbon;

a consumable cleaning member having a useful life related to a useful life of the supply of printer ribbon;

a housing configured to support the ribbon supply spool in a fixed and elevated position relative to the ribbon take-up spool so as to define a substrate cleaning station cavity generally below the ribbon supply spool and above the substantially horizontal path, and wherein the housing is further configured to support the consumable cleaning member proximate the cleaning station cavity.

2. The ribbon cartridge of claim 1, wherein the ribbon cartridge further includes a supply spool enclosure, wherein the supply spool enclosure is in a fixed and elevated position relative to the substantially horizontal path.

3. The ribbon cartridge of claim 2, wherein the substrate cleaning station cavity is disposed substantially below the supply spool enclosure.

4. The ribbon cartridge of claim 3, wherein the consumable cleaning member defines a consumable cleaning member axis about which the consumable cleaning member rotates, and wherein the lowest portion of the supply spool enclosure is elevated relative to the consumable cleaning member axis.

5. The ribbon cartridge of claim 1, wherein the consumable cleaning member is structured to be driven upwardly into the cleaning station cavity when contacting a substrate proceeding along the substantially horizontal path.

6. The ribbon cartridge of claim 1, wherein the consumable cleaning member is spring biased toward the substantially horizontal path by at least one compression spring.

7. A ribbon cartridge of claim 1, wherein the housing defines first and second longitudinally oriented support plates, wherein the ribbon supply spool defines a supply rotational axis and the ribbon take-up spool defines a take-up rotational axis, wherein the supply rotational axis and the take-up rotational axis are positioned transversely relative to the first and second longitudinally oriented support plates, wherein a space is defined between the supply rotational axis, the take-up rotational axis, the first longitudinally oriented support plate, and the second longitudinally oriented support plate, and wherein the housing is structured to position the consumable cleaning member outside the space.

8. A ribbon cartridge for printing on a succession of substrates proceeding along a substantially horizontal path, said ribbon cartridge comprising:

a ribbon supply spool holding a supply of printer ribbon and having an axis of rotation, wherein the ribbon supply spool is substantially surrounded about the axis of rotation by a supply spool enclosure;

a ribbon take-up spool configured to take-up a consumed portion of the supply of printer ribbon;

a consumable cleaning member having a useful life related to a useful life of the supply of printer ribbon;

a housing configured to support the ribbon supply spool enclosure in a fixed and elevated position relative to the substantially horizontal path and configured to support the ribbon supply spool in a fixed and elevated position relative to the ribbon take-up spool; and a cleaning cavity defined between the ribbon supply spool enclosure and the substantially horizontal path, wherein the cleaning cavity is configured to receive the consumable cleaning member.

9. The ribbon cartridge of claim 8, wherein the consumable cleaning member is disposed entirely below a lowest edge of the ribbon supply spool enclosure.

* * * * *